US007469827B2

(12) United States Patent
Katragadda et al.

(10) Patent No.: US 7,469,827 B2
(45) Date of Patent: Dec. 30, 2008

(54) VEHICLE INFORMATION SYSTEMS AND METHODS

(75) Inventors: Lalitesh Katragadda, San Jose, CA (US); Sanjay Jain, Bangalore (IN)

(73) Assignee: Google Inc., Mountain View, CA (US)

( * ) Notice: Subject to any disclaimer, the term of this patent is extended or adjusted under 35 U.S.C. 154(b) by 426 days.

(21) Appl. No.: 11/281,843

(22) Filed: Nov. 17, 2005

(65) Prior Publication Data

US 2008/0054072 A1 Mar. 6, 2008

(51) Int. Cl.
*G07B 15/02* (2006.01)

(52) U.S. Cl. ..... 235/384; 235/375

(58) Field of Classification Search ..... 235/380, 235/384, 381, 375, 492, 493, 486, 487; 705/1; 701/209, 201, 213, 204; 340/3.52, 573.4
See application file for complete search history.

(56) References Cited

U.S. PATENT DOCUMENTS

| | | | | |
|---|---|---|---|---|
| 5,812,069 | A | 9/1998 | Albrecht et al. | |
| 6,356,838 | B1 * | 3/2002 | Paul | 701/209 |
| 6,374,176 | B1 | 4/2002 | Schmier et al. | |
| 6,381,533 | B1 | 4/2002 | Crane et al. | |
| 6,560,532 | B2 | 5/2003 | Cayford | |
| 6,609,659 | B2 * | 8/2003 | Sehr | 235/384 |
| 6,759,972 | B2 * | 7/2004 | Gupta et al. | 340/994 |
| 6,810,321 | B1 | 10/2004 | Cook | |
| 6,965,325 | B2 | 11/2005 | Finnern | |
| 7,245,925 | B2 * | 7/2007 | Zellner | 455/456.1 |
| 2004/0139101 | A1 * | 7/2004 | Watanabe et al. | 707/102 |
| 2005/0251330 | A1 * | 11/2005 | Waterhouse et al. | 701/204 |
| 2006/0095277 | A1 * | 5/2006 | Noonan et al. | 705/1 |
| 2006/0164259 | A1 * | 7/2006 | Winkler et al. | 340/944 |
| 2006/0182055 | A1 * | 8/2006 | Coffee et al. | 370/328 |
| 2007/0042789 | A1 * | 2/2007 | Moton et al. | 455/456.1 |
| 2007/0198276 | A1 * | 8/2007 | Hinrichs et al. | 705/1 |

OTHER PUBLICATIONS

"TrainSTAT™ Automated Vehicle Location (AVL) and Passenger Information Management System (PIMS)," Ensco, Inc., 2004, 2 pages.

'Zipdash' [online]. zipdash, 2005, [retrieved on Jun. 20, 2005]. Retrieved from the Internet: <URL: www.zipdash.com/>.

* cited by examiner

*Primary Examiner*—Thien M Le
(74) *Attorney, Agent, or Firm*—Fish & Richardson P.C.

(57) ABSTRACT

In some of the embodiments described herein, a vehicle information system may be used to generate route map information, schedule information, estimated time of arrival information, or the like based upon location information received from passenger-carried or cargo-carried wireless devices, such as passengers' cellular phones. In such circumstances, a remote device (e.g., a display device at a vehicle station, a network-connected personal computer, or a cellular phone of a person who might board a mass transit vehicle) may access the route map information, schedule information, and other information related to one or more mass transit vehicles.

34 Claims, 6 Drawing Sheets

VEHICLE INFORMATION SYSTEMS AND METHODS

TECHNICAL FIELD

This document relates to generating and providing vehicle information, such as vehicle route information or schedule information.

BACKGROUND

Users of mass transmit vehicles, such as trains, buses, or planes, often rely on route maps and vehicle schedules to properly identify a desirable vehicle, stop location, and time of departure from that stop location. If the route map or vehicle schedules are erroneous, out-of-date, or temporarily adjusted (e.g., due to extreme weather conditions, broken tracks, road construction, or the like), the passengers are often left waiting for excessive amounts of time at the stop location or, in some cases, may never find the appropriate vehicle for their purposes.

A number of factors can affect the design of a system that generates vehicle information and provides access to route map information, vehicle schedule information, and the like. Information reliability is one such factor. If a vehicle information system is unreliable, passengers may dismiss any information provided by the system as being untrustworthy and may become frustrated with the overall mass transit system. For example, in some developing nations, train schedules are published for the benefit of train passengers, but the schedules are frequently erroneous—sometimes causing passengers to wait for hours after the published arrival time. Moreover, in some developing nations, the train schedules are not even published, thereby leaving passengers with past experience and word-of-mouth to determine the appropriate arrival and departure time of the trains.

Another factor that can affect the design of a vehicle information system is the real-time or contemporaneous accuracy on a given day. For example, some vehicle systems, such as trains, may use a monitoring device—designed to periodically track and report the location of the train—that is registered to a particular train and is physically attached to the train's conductor car. In certain circumstances, the train-registered monitoring device can provide updated estimates of the particular train's location on a given day based upon a predetermined route map. Such train-registered monitors, however, are generally complex and require a significant investment from the train companies. Many mass transit vehicle systems—especially those in developing nations—generally do not undergo the significant investment to equip each train with a monitoring device registered thereto, thus leaving the passengers being subject to having no schedule at all or having a published schedule that could be erroneous, out-of-date, or temporarily inaccurate.

SUMMARY

This document describes vehicle information systems and methods that may generate route map information, schedule information, estimated time of arrival information, or the like based upon location information received from passenger-carried wireless devices, such as passengers' cellular phones. In such circumstances, a remote device (e.g., a display device at a vehicle station, a network-connected personal computer, or a cellular phone of a person who plans to board a mass transit vehicle) may access the route map information, schedule information, and other information related to one or more mass transit vehicles. The information may be generated, for example, by analyzing locations of aggregated mobile devices, whether at one point in time or over a time period, such as mobile telephones, and making inferences when multiple devices are observed to be moving together.

In some embodiments, a method of providing information related to a mass transit vehicle's schedule may include receiving location information associated with a plurality of wireless devices carried by passengers or cargo of a mass transit vehicle. The method may also include generating schedule information based at least in part on the location information of the plurality of wireless devices, and transmitting data relating to the schedule information to a remote device.

In other embodiments, a method of generating route map information for a mass transit vehicle may include receiving location information associated with a plurality of wireless devices carried by passengers or cargo of a mass transit vehicle. The method may also include aggregating the location information over a period of time so that the location information represents a plurality of locations of the mass transit vehicle, and generating vehicle path data that substantially includes the plurality of locations.

In some embodiments, a system for providing transportation-related information may include an interface to receive location information associated with a plurality of wireless devices carried by passengers or cargo of a mass transit vehicle, and means for generating schedule information associated with the mass transit vehicle based at least in part on the location information of the plurality of wireless devices. In response to a request from a remote device, the interface may transmit data relating to the schedule information to the remote device.

In certain embodiments, a system for providing transportation-related information may include an interface to receive location information associated with a plurality of wireless devices carried by passengers or cargo of a mass transit vehicle. The system may also include a schedule generator in communication with the interface to determine schedule information related to a future location of the mass transit vehicle. The system may further include a report generator to receive information from the schedule generator and to provide schedule information to a remote device.

In some embodiments, the system may be capable of generating location information associated with moving vehicles using combination of passive devices on the vehicle and active, wireless devices. The active, wireless devices may be adapted to transmit information associated with their own location and information associated with the location of the passive devices, regardless of whether the active, wireless devices are positioned on the moving vehicles.

In certain embodiments, the system may be adapted to represent schedules and routes associated with moving vehicles. The schedules, routes, or a combination thereof may be represented in a compact and derivable, integrable manner using, for example, Galerkin functions.

In some embodiments, various other services that may query or otherwise employ the location, route and schedule data generated by the system. For example, location-based services such as news, traffic, or weather alert services may query or otherwise employ the location, route and schedule data generated by the system.

In certain embodiments, the system may be capable of receiving location information associated with a plurality of wireless devices situated on a moving vehicle and capable of generating more accurate and precise data (related to the vehicle's position, velocity, acceleration, or combination thereof) than the data any single wireless device may report of itself.

In other embodiments, the system may be configured to determine vehicle stop locations based on entry/exit of devices to/from the vehicle. In such circumstances, the system may receive location information associated with a plurality of wireless devices that are entering or exiting a vehicle. For example, the entry/exit locations may be deduced by time history of the location information associated with a wireless device and the deduced pose (position, velocity, and acceleration) history data of the vehicle.

In some embodiments, the system may be adapted to label vehicle stop locations and vehicle routes using statistically aggregated query data of wireless device users who may be aboard the vehicle or positioned at the stop locations.

These and other embodiments may be configured to provide one or more of the following advantages. First, the location and time information corresponding to a particular mass transit vehicle may be obtained from a plurality of passenger-carried wireless devices that are not registered with that particular vehicle. Accordingly, a robust system to gather and report route map information, vehicle schedule information, estimated time or arrival, and other vehicle information may be developed without the requirement of location monitoring devices that are physically mounted and registered to each and every mass transit vehicle in the fleet. By using wireless devices that are not registered to particular vehicles, the vehicle location information gathering processes may be accomplished without the excessive costs and maintenance attributed to monitoring devices that are physically mounted to each and every vehicle in the fleet.

Second, the location information gathered from the plurality of passenger-carried wireless devices may be continuously or periodically updated. As such, the route map data and schedule data may be incrementally modified to reflect any changes to the route or schedule of a mass transit vehicle.

Third, potential passengers may readily access the systems described herein to receive current and accurate information related to a particular mass transit vehicle. For example, using a text messaging service on the potential passenger's cellular phone, he or she may request information of when a particular vehicle will arrive at a nearby vehicle stop location.

Fourth, the systems and methods described herein may be used to provide a number of service applications to passengers and potential passengers of one or more mass transit vehicles. For example, the system may be used to provide trip planning services to potential passengers or situational awareness features and location-based services for those passengers aboard a particular mass transit vehicle.

Fifth, the route of a mass transit vehicle may be determined without relying upon outdated maps. Rather, the vehicle route may be more accurately determined using a set of global coordinates or the like, and thereafter the vehicle's route may overlay a preexisting map image. In such circumstances, the system may identify vehicle paths or stop locations that were previously hidden or unmapped.

Sixth, the system may be implemented for purposes of fleet management. For example, a business or municipality that operates a fleet of vehicles may use the methods describe below review vehicle schedules, track a vehicle's progress, or other fleet management tasks. One or more of these and other advantages may be provided by the systems and methods described herein.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

The systems and methods described herein relate to generating route map information, schedule information, estimated times of arrival, or other vehicle information based upon location information received from passenger-carried wireless devices, such as passengers' cellular phones. In those circumstances, substantially reliable (and updateable) vehicle information may be provided to a user of a remote device without requiring a monitoring device that is registered with, and physically mounted to, a particular vehicle.

Figure 1:
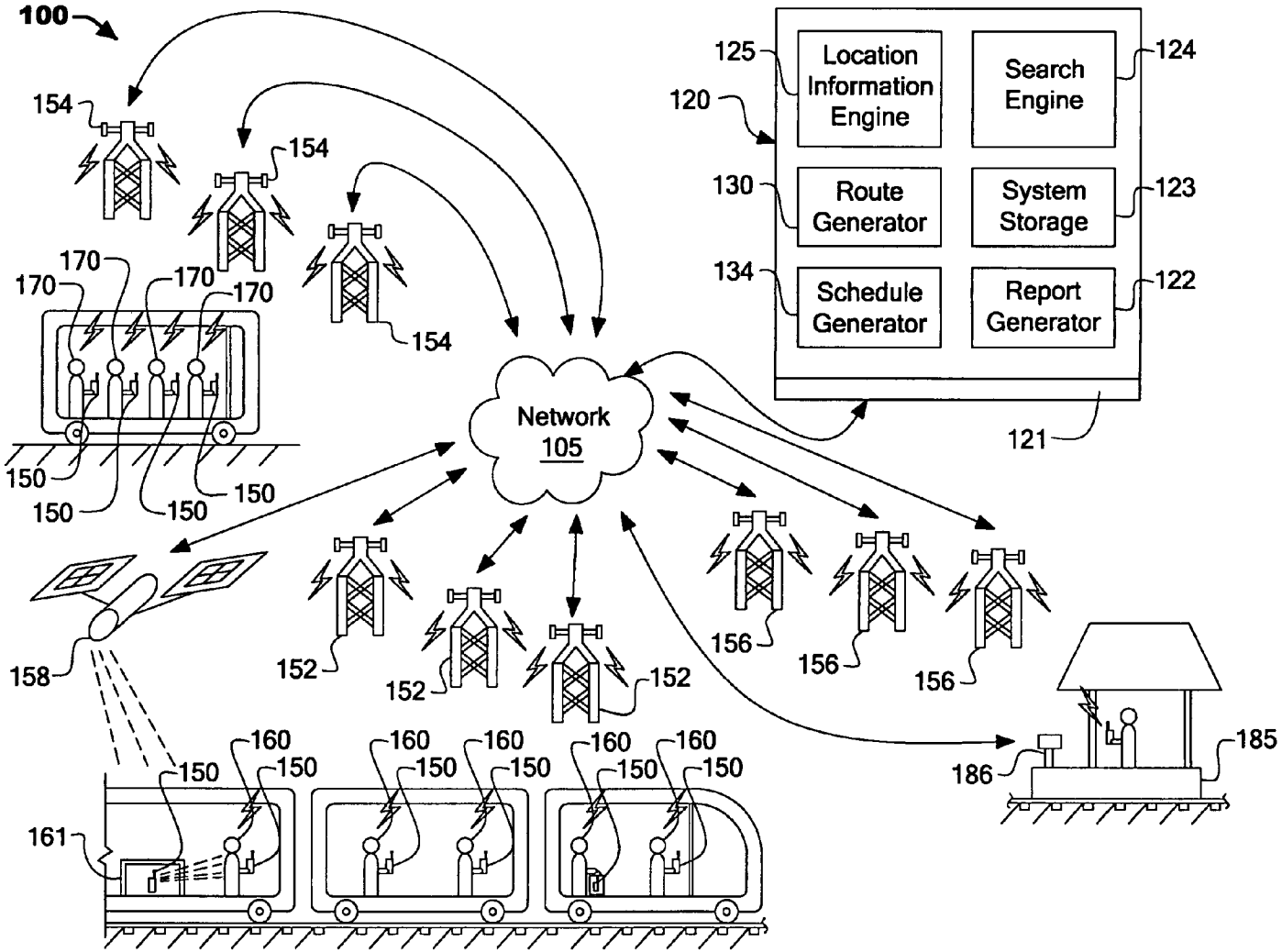
FIG. 1 is a diagram of a vehicle information system.

Referring to FIG. 1, a vehicle information system 100 may include an information provider 120 that is connected to a network 105, such as the internet, so as to receive and transmit certain information related to one or more vehicles. The system 100 may also include a plurality of wireless devices 150 that are connected to the network 105 via one or more antennas towers 152, 154, and 156 or, in some embodiments, via one or more satellites 158. As described in more detail below, the information provider 120 is capable of receiving information via the network 105 related to the geographic location of the wireless devices 150.

Some of the wireless devices 150 may be carried by cargo 161 or passengers 160 and 170 in mass transit vehicles, such as trains 165, buses 175, airplanes, or the like. For example, the wireless devices 150 may comprise cellular phones that are carried by a plurality of passengers 160 aboard a particular train 165. As such, the information provider 120 may receive location information over a period of time—the location information being associated with a group of cellular phones or other wireless devices carried by passengers 160 of that particular train 160. It should be understood that the information provider 120 may receive the location information either directly or indirectly from the cellular phones. For example, the information provider 120 may receive location information indirectly from a cellular phone via a telephone service carrier that uses triangulation techniques based on signals from the cellular phone to generate location information before transmitting the location information to the provider 120 (described in more detail below). In another example, the information provider 120 may receive location information directly from a cellular phone via an embedded GPS sensors that generates the location information, which is subsequently sent to the information provider 120 via the network 105 (described in more detail below).

In some embodiments, the wireless devices 150 may include passive devices, active devices, or a combination thereof. For example, some wireless devices 150 in the system may be short-range wireless devices that are capable of communicating with nearby wireless telephones or other active communication devices, as shown, for example, by device 150 in the cargo 161 of FIG. 1. In such circumstances, the short-range wireless devices (e.g., RFID devices, Bluetooth devices, and IEEE 802.11/16-compliant devices) may be carried by cargo 161 or passengers 160 of the mass transit vehicle or may be otherwise unregistered to the vehicle. The short-range wireless devices may communicate with at least one nearby wireless telephones or other active receiver/communication device (represented for illustrative purposes by the dotted line from the cargo 161 in FIG. 1) so that location information associated with the short-range wireless devices can be transmitted to the information provider 120 as described in more detail below.

Based upon the location information associated with the plurality of wireless devices 150, the information provider 120 may generate route map data, schedule data, and other information related to the mass transit vehicle. Such data can be provided, via the network 105, to at least one remote device (e.g., a personal computer, a display device 186 at a vehicle stopping station 185, or a wireless device 150 of a remote user 180) so that a user 180 can effectively plan an appropriate travel route and schedule.

The wireless devices 150 carried by the passengers 160, 170 and the remote users 180 may connect to the network via one or more wireless service provider networks, which may provide, for example, voice and data services. A variety of wireless devices 150 may access the services provided by the wireless service provider networks, such as a wireless cellular phone, a wireless-enabled personal digital assistant (wireless PDA), portable computers, or a short-range device (e.g., RFID device, a Bluetooth device, and an IEEE 802.11-compliant device) that communicates with any of the aforementioned devices located in proximity thereto. The wireless service provider network may comprise a plurality of antenna towers 152, 154, and 156, through which data and voice communications and services may be transmitted or received.

In the embodiments in which the network 105 includes the Internet, the wireless service provider network may connect the wireless devices 150 to the Internet 105 using a direct server connection, a public switched telephone network (PSTN), or the like. In circumstances in which the location information of the wireless devices 150 is determined by the wireless service provider service (e.g., using triangulation between the known geographic coordinates of service provider base stations), the raw or anonymous location data of the wireless devices 150 may be continuously or periodically transmitted via the network 105 from the wireless service provider service to the information provider 120.

In some circumstances, one or more of the wireless devices 150 may communicate with one or more satellites 158 to connect to the network 105, to determine geographic location information, or both. For example, a wireless device 150 may comprise a satellite phone that is capable of transmitting data and voice communications through one or more communication satellites to the network 105. In another example, the wireless devices 150 may receive signals from a global positioning system (GPS) satellites. If a wireless device 150 is equipped with a GPS unit, it may determine a precise geographic location of the wireless device 150. The GPS location can be communicated to the information provider 120 through the network 105 using antenna towers 152, 154, and 156 or using communication satellites.

Still referring to FIG. 1, the geographic location information of the wireless devices 150 may be determined by systems other than GPS. For example, the location information of the wireless devices 150 may be determined using base-station triangulation technologies, base station location information, cell identification, explicit requests of the user to provide location information, inferences drawn from user data such as location-specific requests, and location identification software running on a wireless device 150.

In one exemplary embodiment, a plurality of passengers 160 aboard a train 165 may carry wireless devices 150 such as cellular phones. Each cellular phone 150 may be adapted to periodically broadcast its presence to one or more of the nearby antenna towers 152. The cellular phones 150 may receive signals from several different antenna towers 152 and may transmit a time of arrival for a synchronized signal from each tower 152. From the time-of-arrival transmissions, the wireless service provider may be able to calculate a relatively precise location of the wireless device 150 using, for example, a technique such as Advanced Forward Link Trilateration (AFLT). In such circumstances, the location information—whether GPS location data, AFLT location data, or a location determined in some other manner—may be transmitted from the wireless service provider to the information provider 120 via the network 105. It is also contemplated that a plurality of passengers 170 aboard a bus 175 or other mass transit vehicle may carry wireless devices 150, the location of which can be determined using the previously described techniques.

In some embodiments in which the location information of the wireless device 150 is determined by AFTL or other antenna tower triangulation techniques, the wireless device 150 may be augmented with a GPS unit. Such augmentation can increase the accuracy of the location calculation or can provide location information during the moments when the wireless device 150 is not communicating with the antenna towers 152, 154, or 156. In addition or in the alternative, the wireless device 150 may be equipped with inertial sensors (e.g., linear accelerometer, angular accelerometer, compass, or the like) to increase the accuracy of the location calculation or to provide location information during the moments when the wireless device 150 and GPS unit are unable to provide accuracy location determinations (e.g., inside deep tunnels). The wireless device may also store location information locally and transmit it in batches or in summarized form, and may also calculate speed or velocity, and also transmit such calculated values.

The location calculations from each of the antenna tower triangulation, the GPS unit, and the inertial sensor system may be combined using sensor fusion techniques, such as an Extended Kalman Filter (EKF) technique, clustering technique, or outlier pruning technique, to calculate an accurate estimate of the location of the wireless device 150. In such embodiments, the location information may be transmitted from the wireless device 150, to the wireless service provider, and then to the information provider 120 via the network 105.

Figure 2:
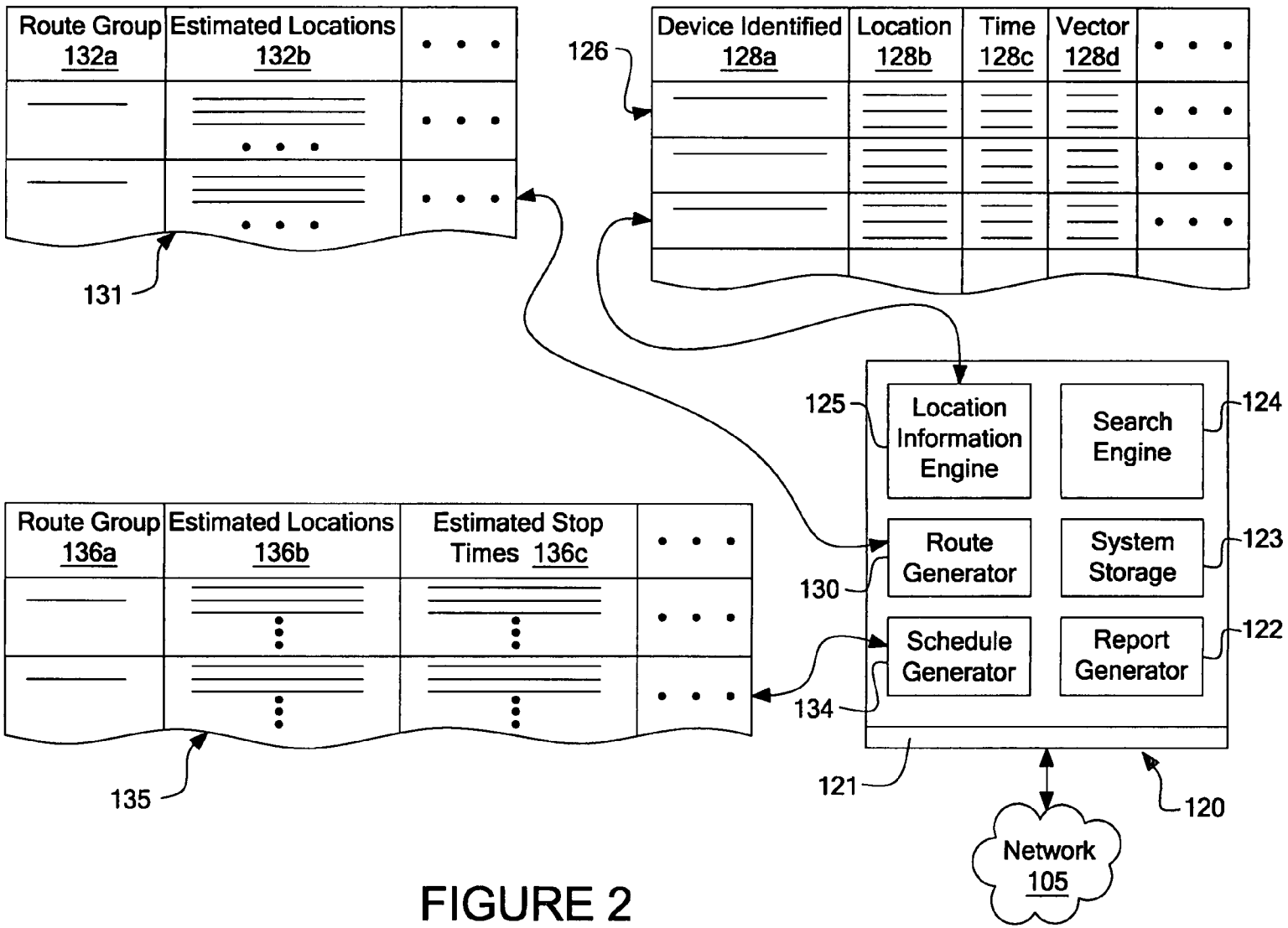
FIG. 2 is a schematic diagram of an exemplary information provider of the vehicle information system of FIG. 1.

FIG. 2 is a schematic diagram of an exemplary information provider 120 of the vehicle information system 100 of FIG. 1. As previously described, the information provider 120 is capable of receiving information via the network 105 related to the geographic location of the wireless devices 150. The information provider 120 may also receive requests for data from users and generate responses to the requests. For example, the user 180 of a remote device (e.g., the display device 186 or the wireless device of the user 180 shown in FIG. 1) may request route map information for a particular mass transit vehicle. In such cases, a report generator 122 may retrieve data related to the request from a system storage 123 and then transmit such data to the remote device. The data may also be prepared before a request is received.

In some embodiments, the information provider 120 may comprise an Internet search engine 124 that is capable of providing information such as real-time traffic information, weather forecasts, news or real-time stock quotes. The information may include text, graphics, animations, audio, video or other appropriate information. Alternatively, in some embodiments, the information provider 120 may be a subsystem of an Internet search engine.

In this embodiment, the information provider 120 is connected to the Internet 105 to receive location information of the wireless devices 150 (FIG. 1) and to communicate with users who may be interested in accessing the services provided by the information provider 120. The information provider 120 could also be connected to other networks (not shown), such as, for example, an internal business network, or a local wireless communication network.

The information provider 120 may be embodied in a bank of server computer systems or as a data center. The information provider 120 may be divided into separate systems to allow for scalability, data integrity, or data security, and it may be connected to the Internet 105 or to another network in any of a variety of ways, as is commonly known. Furthermore, the information provider 120 may comprise subsystems other than those shown in FIGS. 1-2, depending upon the various functions that will be performed by the information provider.

The information provider 120 may communicate through an external interface 121. Through the external interface 121, the information provider 120 receives location information data, receives data requests, and transmits responses. The information provider 120 may also include an internal interface (not shown in FIG. 2) to internally route information to and from the proper subsystems. For example, the internal interface may comprise interface devices for a high-speed, high-bandwidth network such as SONET, Infiniband or Ethernet, or any suitable communication hardware operating under an appropriate protocol such that the information provider 120 can respond to a large number of distinct requests simultaneously. The external interface 121 may comprise network interface cards (NICs) or other communication devices and may similarly include components or interfaces of a high-speed, high-bandwidth network.

Data requests, such as data requests from users, may be received through the external interface 121 and handled by another subsystem of the information provider 120. In some embodiments, the data requests may be in the form of a text message transmitted from a short messaging service (SMS) application of a remote wireless device such as a cellular phone or a PDA device. In such circumstances, the SMS requests from a particular wireless devices 150 may be the source of the location information of that wireless device 150 (e.g., the location information for that wireless device 150 may be embedded in the data transmitted as part of the SMS request). In other embodiments, the data requests may be in the form of HTML data, XML data, image map data, synthesized speech, or the like transmitted from a browser application of a remote personal computer system. The information provider 120 may reformat from, for example, HTML or text format, to search terms or strings that are compatible with the report generator 122 or the search engine 124.

In some embodiments, the data requests may be implicit (e.g., requests from the user to send information regarding whether the vehicle that she is presently aboard or will board in the future will be more than five minutes late or is going to enter a traffic jam) or inferred (e.g., the information provider 120 is capable of determining the user's location based upon the user's wireless device and infers a data request based on the nature of the user's location or other personal information supplied by the user).

The information generated in response to a request may be converted to another format in a manner that allows it to be used by the requesting device. For example, the information provider 120 may convert data that is in an internal format to HTML, WAP, XML, VoiceXML, or a textual data format that can be used, for by the wireless device's SMS application/text-messaging function. After formatting the response, the information provider 120 may transmit it to the requesting user via its external interface 121.

Still referring to FIG. 2, when location information of the wireless devices 150 (FIG. 1) is received by the information provider 120, a location information engine 125 may gather or organize such information, for example, into a location information database 126. The location information database may include a number of categories 128*a-d* pertaining to the location information of particular wireless devices 150.

For example, the database 126 may include a "device identifier" category 128*a*, which includes a unique identifier for each wireless device 150 having location information that is received by the information provider 120. The unique identifier may be a telephone number for a particular cellular phone device, a serial number, a signature embedded in the data or wireless signal of the wireless device 150, or other identification code assigned by a wireless service provider when each cellular phone 150 or other wireless device periodically broadcasts its presence to one or more of the nearby antenna towers 152, 154, or 156. An identifier not related to the device 150 may also be provided so that a user may be assured of anonymity from the information provider 120.

The location information database 126 may also include a "location" category 128*b* and a "time" category 128*c* associated with each "device identifier" category 128*a*. The "location" category 128*b* may include a series of entries representative of the geographic location measurement of the wireless device 150. The geographic location measurement may comprise, for example, GPS coordinates, global longitude and latitude coordinates, other coordinates that are representative of a geographic location, or raw data associated with the location of the wireless device 150 (e.g., signals from triangulation units, accelerations measurements from inertial sensors, or the like). Such coordinate entries may be directly compatible with a route generator 130 (described in more detail below). Each of these entries may be stored over a period of time, and the particular time of each geographic location measurement may be entered into the "time" category 128*c*. Accordingly, each entry in the "device identifier" category 128*a* may include a series of corresponding "location" and "time" entries as the location information of the wireless devices 150 is periodically received by the information provider 120 via the network 105.

In some embodiments, the location information database 126 may include a "vector" category 128*d* associated with each "device identifier" category 128*a*. The vector category 128*d* may be representative of the approximate velocity and direction of the wireless device 150 at the particular time of each geographic location measurement. The velocity and direction may be measured, for example, by a GPS unit in the wireless device 150 or may be calculated, for example, by the wireless service provider after performing the antenna tower triangular techniques. In such circumstances, the velocity/direction data may be transmitted to the information provider 120 via the network 105.

Alternatively, the velocity/direction data may be calculated by the location information engine 125 using, for example, the relative location/time differences in the associated "location" and "time" categories 128*b* and 128*c*. Such calculations by the location information engine 125 may be more accurate if the time between the geographic location measurements is reduced or if variable sampling or indexing techniques are employed (e.g., sample particular wireless devices more frequently as the non-linearity—variation from the predicted location, velocity, acceleration, or other functions—increases). As described in more detail below, the entries in the vector category 128*d* and other categories may be used by a route generator 130, a schedule generator 134, the report generator 122, or another subsystem to sort various groups of wireless devices 150, to determine vehicle stop locations, or to determine other vehicle information (e.g., estimated time of arrival).

It should be understood that the location information database 126 may include other categories associated with each "device identifier" category 128*a*. For example, the location information database 126 may include a category that stores data related to acceleration measurements from an inertial sensor in the wireless device 150. In another example, the location information database 126 may include a category that stores the error bounds related to the location, time, or vector data.

Furthermore, even after the entries in the location information database 126 have been aggregated to generate vehicle route data and vehicle schedule data, the entries in the location information database 126 may be continuously or periodically updated and refreshed to provide current location information for particular mass transit vehicles. For example, after the information provider 120 has identified and generated vehicle route data after aggregating location and time information or a period of time, the information provider 120 may continuously track the location information of a group of wireless devices 150 that are aboard a particular vehicle so as to determine the current location of that vehicle. As described in more detail below, the current location of the vehicle may be compared with the previously recorded route data and schedule data to determine estimated times of arrival, to determine which vehicles are currently operating ahead of schedule or behind schedule, or the like.

In some circumstances, the volume of data received by the information provider 120 may be so great that the data stored in the location, time, vector, and other categories 128*a-d* may be stored only for a brief period of time. For example, the data related to a particular wireless device 150 may be cached for a time sufficient to derive the actual geographic location of that wireless device 150 before it is discarded. In such cases, much of the data would be discarded while the information provider 120 would store only aggregate residuals such as error bounds, geographic locations, velocities, accelerations, a sub-sample of a ranked version of the raw data (for subsequent analysis), or the like.

Still referring to FIG. 2, the information provider 120 may include one or more subsystems to generate vehicle information based upon the location information of the wireless devices 150. As previously described, the location information of the wireless devices 150 may be stored in the location information engine 125, and this information may be used by other subsystems of the information provider 120. In this embodiment, the information provider 120 includes the route generator 130 to generate route data of particular mass transit vehicles based upon the location information of the wireless devices 150 carried by passengers in those particular vehicles. The route generator 130 may include a database 131 that is continuously or periodically updated based upon the data by the information provider 120 from the wireless devices 150.

The route database 131 may include a "route group" category 132*a* to distinguish a particular set of data points representative of a vehicle's geographic route. For example, the "route group" category 132*a* may include a name identifies with a particular route, such as the "commuter blue line," "train #9," "bus #17," "flight #1611," "New Delhi westbound train," or the like. In another example, the "route group" category may include identifier numerals assigned by the information provider (e.g., group 835-912) to distinguish a set of data having, for example, a similar set of vector entries from vector category 128*d* and a similar location entries from the location category 128*b*.

The route database 131 may also include an "estimated locations" category 132*b* having a series of entries representative of the approximated geographic locations of the vehicles that are tracked using the location information of the wireless devices 150. The geographic location entries may comprise, for example, GPS coordinates, global longitude and latitude coordinates, or other coordinates. The series of entries in the "estimated locations" category 132*b* may represent a series of locations of a vehicle measured or inferred over a period of time. Thus, each entry in the "route group" category 132*a* may be associated with a plurality of entries in the "estimated locations" category 132*b*. The series of entries in the "estimated locations" category 132*b* may be used by the report generator 122 to provide route map data or provide lists of geographic locations representative of a vehicle path.

In this embodiment, the route generator 130 may sort entries stored in the location information database 126 based upon a group of device identifiers in category 128*a* sharing a similar set of vector entries from vector category 128*d* and a similar set location entries from the from the location category 128*b*. As described in more detail below in connection with FIGS. 4-6, this selected group of device identifiers may be representative of wireless devices 150 traveling aboard a mass transit vehicle (e.g., train 165, bus 175, airplane, or the like). The route generator 130 may assign a route group entry into the "route group" category 132*a* for this sorted data in the location information database 126.

The location information entries (category 128*b*) for the selected group of device identifiers in category 128*a* may be used by the route generator 130 to assign a list of approximate locations in category 132*b*. The approximate locations of the vehicle may be calculated using statistical techniques based upon the "location" entries in category 128*b*. Accordingly, a subset of data in the location information database 126 may be used by the route generator 130 to create a route group and an associated list of approximate locations of a mass transit vehicle. The associated list of approximate locations of the mass transit vehicle can be incrementally updated as the entries in the location information database are updated or refreshed in the future.

In some embodiments, the route generator 130 may characterize a route as functions of a single variable, for example, variable s, where s goes from 0 to D and where D is the total distance of a route. Thus, each route may be characterized as functions x(s), y(s), and z(s) (e.g., representing the three-dimensional coordinates of the vehicle on the Earth's surface), as functions lat(s), long(s), elevation(s) (representing the latitude, longitude, and elevation of the vehicle), or the like. These function may be recorded in the "estimated locations" category 132*b* or another category associated with the "route group" category 132*a*. As such, each route may be captured as a series of location points (as described above), as a series of one or more functions that capture the approximate paths of the vehicle, or a combination thereof. By characterizing the routes as one or more functions, the route generator 130 may substantially compress the data necessary to characterize each route and may substantially speed up any query or search processes.

One example of a process used to generate the one or more functions that characterize a route is to identify clusters of wireless devices that are traveling through the same space (e.g., x-y-z coordinates or latitude-longitude-elevation coordinates) for short periods of time (e.g., from 1 to 15 minutes or more). Then, route segments may be generated for each of these short time periods. After a series of route segments have been generated, the route segments may be combined into one route path characterized by one or more functions if the route segments are continuous (e.g., one end of a route segment matches the beginning of a second route segment). If more than two route segments meet at a single location, that location may be identified as a regular stop, a passenger station, or the like. As more location information is received by the information provider 120, the route functions may be further refined by analysis to determine if a predominant number of wireless devices 150 travel from one of the route segments to the next.

Also in this embodiment of the information provider 120 depicted in FIG. 2, a schedule generator 134 may be used to generate vehicle schedule data of particular mass transit vehicles based upon the location information of the wireless devices 150 carried by passengers in those particular vehicles. The schedule generator 134 may include a database 135 that is continuously or periodically updated based upon the data received by the information provider 120. The schedule generator database 135 may include "route group" category 136*a* to distinguish a particular set of data points representative of a vehicle's geographic route. The entries in the "route group" category 136*a* may be assigned based upon sorted groups of in the location information database 126 (as previously described in connection with the route generator database 131) or may be retrieved directly from the route generator database 131 (e.g., from category 132*a*).

Associated with each entry in the "route group" category 136*a* may be a series of entries in the "regular stop locations" category 136*b* and the "estimated stop times" category 136*c*. The series of entries in the "regular stop locations" category 136*b* may be determined by analyzing when a group of wireless devices 150 aboard a vehicle remain at a similar location for an extended period of time. Such an analysis may be conducted by analyzing when a selected group of device identifiers in the location information database 126 share a similar string of "location" entries and "time" entries. The entries in the "regular stop locations" category 136*b* may be selected from these sorted "location" entries in the location information database 126.

The regular stop locations of the vehicle may be calculated using statistical techniques based upon the "location" entries in category 128*b*. Also, the entries in the "estimated stop times" category 136*c* may be selected from the corresponding "time" entries in the location information database 126. Accordingly, a subset of data in the location information database 126 may be used by the schedule generator 134 to create a list of estimated stop locations of a mass transit vehicle and an associated list of stop times for a particular route group. The series of entries in the "regular stop locations" category 136*b* and the "estimated stop times" category 136*c* may be used by the report generator 122 to provide vehicle map data or provide lists of locations representative of the vehicle's regular stopping locations.

As previously described, in some embodiments, the route generator may characterize a route as functions of a single variable, for example, variable s. Thus, each route may be characterized as functions x(s), y(s), and z(s) (e.g., representing the three-dimensional coordinates of the vehicle on the Earth's surface), as functions lat(s), long(s), elevation(s) (representing the latitude, longitude, and elevation of the vehicle), or the like. In such embodiments, the distinction between the route and the schedule is imposition of time. Thus, a schedule may require a function t(s), which represents a function of time relative to the variable "s," to be generated along with the route functions (e.g., x(s), y(s), and z(s)). These functions may be recorded in one of the categories associated with the "route group" category 136*a* of the schedule generator 135. Accordingly, the processes for generating route functions as previously described can be used to generate route and schedule data contemporaneously. It should be understood that a single route may have multiple such schedules (e.g., t1(s), t2(s), and so on). Functions suitable to characterize schedules may include selecting s points between which acceleration is piecewise linear, galerkin functions, second order polynomials (e.g., c2 continuous functions), or the like.

One example of a process to generate these schedule functions includes taking data captured from any time instant (e.g. a very short time interval) as examples of these schedules and attempting to merge these schedules with others based on similarity with other schedules offset by time constants. If the time constants are uniformly spaced daily or every "k" days or every "m" minutes, they may be classified as repeating schedules that repeat according to the pattern found. The process to determine these repeating schedules is using statistical techniques. For example, the statistical techniques may include employing the least squares or SVD techniques, creating a standard deviation or some other density function from the mean, determining a confidence based on the number of distinct schedule examples. In another example, the statistical techniques may include using Savitsky Golay techniques.

Furthermore, the series of entries in the "regular stop locations" category 136*b* and the "estimated stop times" category 136*c* may be used by the report generator 122 to provide data corresponding to the vehicle's estimated time of arrival at a particular stop location. For example, a remote user of a wireless device 150 may use an SMS application to send a text message requesting the estimated time of arrival of a vehicle on a particular route at a particular stop location (e.g., text message sent to information provider may include "estimated arrival time of 4:30 Caltrain to Palo Alto"). This data request from the remote wireless device may also include the current time and the remote user's location information, which could be manually entered by the user or automatically embedded in the data request after a determination using any of the previously described GPS or triangulation techniques.

The information provider 120 may receive this data request and parse the information into the appropriate text components. The information provider may identify the particular route that was queried by the remote user (i.e., "4:30 Caltrain to Palo Alto") and compare the remote user's location information to the nearest stop location (e.g., an entry in the "regular stop locations" category 136*b*) for that identified route. Then, the information provider 120 may compare the most recent location and speed information for that particular vehicle (using information from the group of wireless devices that are currently aboard the identified vehicle route) to the historical or previously aggregated schedule data for the identified route to determine the estimated time of arrival. The data corresponding to the estimated time of arrival may be transmitted back to the SMS application or other application of the remote user's wireless device. It should be understood that the routes stored by the information provider 120 may be labeled by human intervention or by some other external application that is capable of identifying and labeling the routes. For example, the routes may be labeled by workers assigned to label routes that stored by the information provider 120, by users who access an interface to label particular routes, by collaborative filtering or data requests from users (e.g., text messages), or other such processes.

The embodiments of the information provider 120 are not limited the illustrative embodiment depicted in FIG. 2. For example, the operations and the databases of the route generator 130 and the schedule generator 134 may be combined into a single subsystem. Furthermore, the route generator 130 and the schedule generator 134 may be subsystems of the report generator 122. In these and other embodiments, the report generator 122 may be equipped to provide route map data, schedule data, estimated time of arrival data, and other vehicle information, either collectively or separately, to a remote device (e.g., a personal computer, a display device 186 at a vehicle stopping station 185, or a wireless device 150 of a remote user 180 as shown in FIG. 1) so that the user 180 can effectively plan an appropriate travel route and schedule, as described in more detail below.

Figure 3:
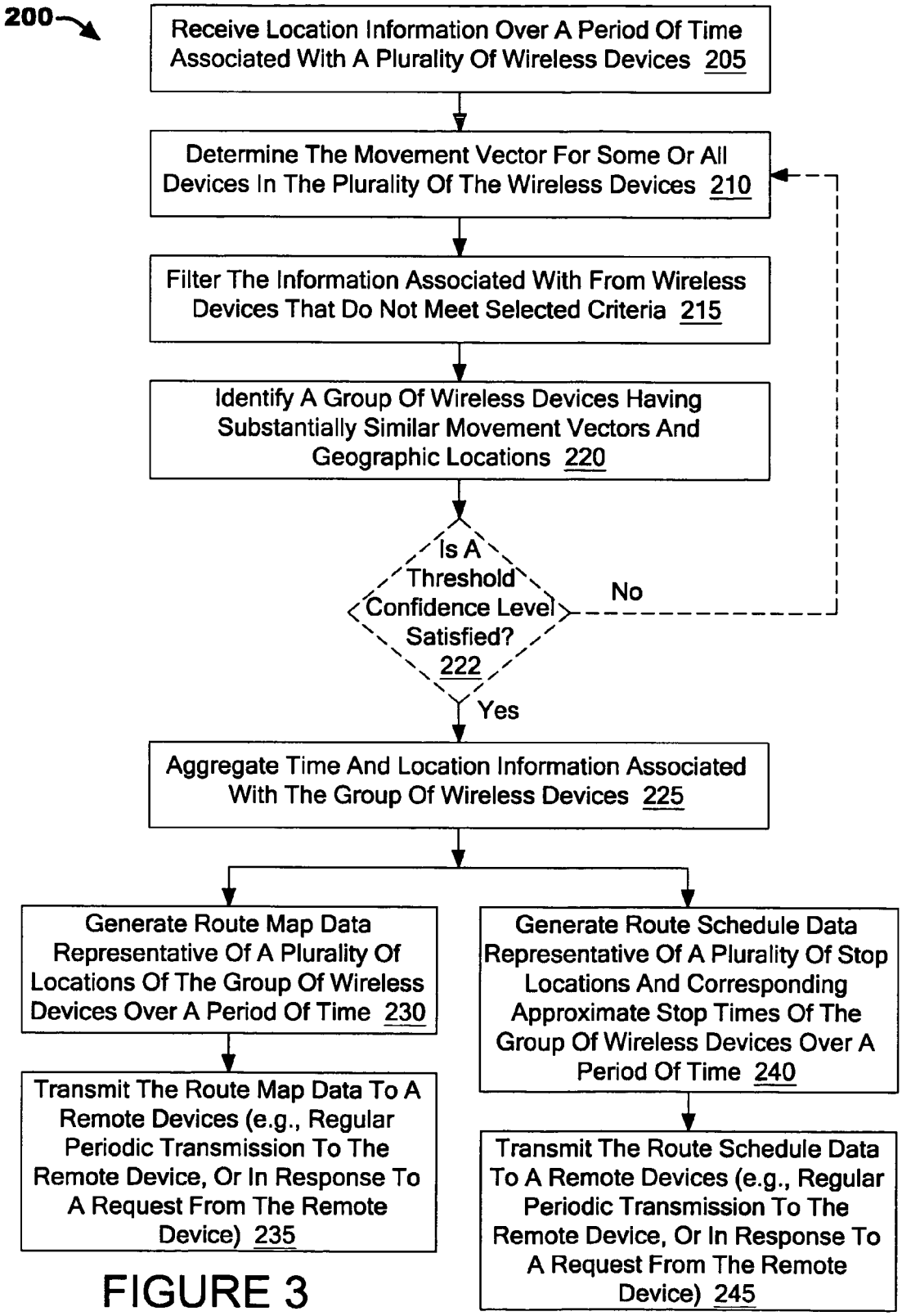
FIG. 3 is a flow chart showing an exemplary method for generating and providing vehicle information

FIG. 3 is a flow chart showing one exemplary method 200 for generating and providing vehicle information. In operation, the information provider 120 may generate route map data, schedule data, estimated times of arrival, or and other information related to one or more mass transit vehicles based upon location information received from a plurality of wireless devices 150, such as a plurality of passengers' cellular phones aboard the mass transit vehicles. The exemplary method 200 depicted in FIG. 3 and other methods described herein may be implemented, for example, using one or more computer systems as described in more detail below, and may be stored as instructions on a recordable media so that the methods are performed when the instructions are executed (as described, for example, in more detail below).

In this embodiment of the method 200, the information provider 120 may perform the operation 205 of receiving location information over a period of time associated with a plurality of wireless devices 150. In some implementations, the location information may be received (directly or indirectly, as previously described) from a plurality of wireless devices 150, such as cellular phones, that are carried by passengers or cargo aboard a mass transit vehicle (e.g., a train 165, a bus 175, or a plane). As previously described, the location information may be sent, for example, via the antenna towers 152, 154, or 156 and the cellular service provider and then through the network 105 (e.g., the internet). The information provider 120 may receive the location information from the network 105 through its external interface 121.

Still referring to the method 200 illustrated in FIG. 3, the information provider 120 may perform the operation 210 of determining the movement vector for some or all devices in the plurality of the wireless devices 150. As previously described in connection with FIG. 2, the information providers 120 may include the location information engine 125 or other similar subsystem (e.g., route generator 130, schedule generator 134, or the like) that is capable of determining the movement vector of some or all of the wireless devices 150 for which it received location information. The movement vector may be representative of the approximate velocity and direction of the wireless device 150 at the particular time of each geographic location measurement. The information provider 120 may determine the movement vector for each device separately, or the information provider 120 may determine the movement vector for only some of the wireless devices 150 that are traveling together aboard a vehicle. For example, some of the wireless devices 150 may be equipped with inertial sensors that may directly report the movement vectors of that particular device.

In operation 215, the information provider 120 may filter the information received from wireless devices that do not meet selected criteria. For example, the information provider 120 may include a subsystem (location information engine 125, route generator 130, schedule generator 134, or the like) that uses statistical techniques to filter information received from wireless devices 150 that (1) are not geographically clustered near other wireless devices 150 (e.g., a person carrying a cellular phone who is walking alone on a sidewalk), or (2) are not traveling at a similar rate of speed and in a similar direction as other wireless devices 150 (e.g., a plurality of cellular phone users who are near a common street corner but are walking, biking, or driving in different directions or at different speeds). Such filtering may permit the information provider 120 to identify a group of wireless devices 150 having substantially similar movement vectors and geographical locations, as shown in operation 220.

For example, the information provider 120 may include a subsystem that is capable of identifying wireless devices 150 having a similar set of movement vectors at similar geographic locations such that those wireless devices 150 may be identified, to a reasonable degree of certainty, as collectively riding aboard a mass transit vehicle (e.g., a train 165, a bus 175, or a plane). Locations and movement vectors may also be recorded over a period of time to help ensure that individuals are moving together. Also, each device may transmit location and vector information independent of other devices so that data collection is not truly simultaneous. As a result, interpolation or other adjustments may be applied to the location and vector information to set the relevant devices in a common time domain.

It should be understood that an iterative filtering process may be required to identify a group of wireless devices 150 that are traveling together aboard a vehicle. In one embodiment, the method 200 may include a operation 222 are determines a confidence level for the group of wireless devices 150 that were previously identified. If the confidence level does not satisfy a particular threshold (e.g., there is a low confidence that all of the wireless devices in the identified group are actually traveling together aboard the same vehicle), another iteration of filtering may be employed. The subsequent iterations of filtering may use different criteria or statistical techniques in order to further refine the identified group of wireless devices 150. In this embodiment, if the confidence level is determined to satisfy a particular threshold level, the method may proceed to subsequent operations.

In operation 225, the information provider 120 may aggregate time and location information received from the group of wireless devices 150 (e.g., the group of wireless devices 150 carried by train passengers 160 as shown in FIG. 1). After the group of wireless devices 150 that are riding aboard a mass transit vehicle is identified, the location information of those particular wireless devices 150 may be tracked over a period of time. As previously described in connection with FIG. 2, this location and time information may be used to generate vehicle route data or vehicle schedule data without the use of electronic components that are physically attached to the vehicle. It should be understood the group of wireless devices may be subject to minor changes over that period of time, for example, when a passenger departs the mass transit vehicle and another person boards that vehicle. In such circumstances, the information provider may redefine the group of wireless devices 150 aboard the mass transit vehicle based upon the location and movement vector information of the wireless devices 150.

Based upon the wireless devices' location and time information aggregated by the information provider 120, the information provider 120 may have the capability to generate vehicle route data, vehicle schedule data, or both. In this implementation of the exemplary method 200 depicted in FIG. 3, the operations for generating route data and for generating schedule data are shown as separate and independent from one another. It is contemplated that, in other implementations, the generation of route data and the generation of schedule data may be performed separately but dependent on one another or collectively and contemporaneously with one another.

In operation 230, the information provider 120 may generate route map data representative of a plurality of location of the group of wireless devices 150 over a period of time. For example, the information provider 120 may include a subsystem, such as the route generator 130 (FIG. 2), that is capable of generating a list of location data for particular groups of wireless devices 150 that were previously determined to have substantially similar movement vectors and geographical locations. This location data for the group of wireless devices 150 may be used, for example, to create a route map of the mass transit vehicle on which the group of wireless devices were believed to be aboard.

In operation 235, the information provider 120 may transmit the route map data to a remote device (e.g., a personal computer, a display device 186 at a vehicle stopping station 185, or a wireless device 150 of a remote user 180). The route map data may be transmitted to the remote device as part of a regular, periodic transmission or as part of a response to a data request from a particular remote device. For example, the information provider 120 may include a report generator 122 or another subsystem that is capable of receiving data requests and obtaining route map data from the route generator 130. In response to the data requests, the report generator 122 may transmit one or more packets of information that includes the route map data so that a route map may be displayed on a remote device.

In some embodiments, the route map data and other such information may be stored in an index internal to the information provider 120. The index may be updatable and search able, and in some circumstances, two or more parallel indexes that are optimized for various uses can be employed by the information provider 120. The index may be used, for example, by various services (e.g., a location-based alert service or other services described in more detail below) that are configured to query the index for particular route map data and/or other information and configured to transmit such data to a remote device (e.g., a wireless phone having an SMS application). In such circumstances, the service may be a report generator 122 in that it transmits the route data to a remote device.

Referring now to operation 240, the information provider 120 may generate schedule data representative of a plurality of stop locations and corresponding approximate stop times of the group of wireless devices 150 over a period of time. For example, the information provider 120 may include a subsystem, such as the schedule generator 134 (FIG. 2), that is capable of generating a list of regular stop locations for particular groups of wireless devices 150 that were previously determined to have substantially similar movement vectors and geographical locations. This location data for the group of wireless devices 150 may be used, for example, to create a schedules or stop location maps for the mass transit vehicle on which the group of wireless devices were believed to be aboard.

Where a route map has previously been identified, individuals aboard a vehicle on that route may be more readily identified than when the system has no knowledge of a transit system. Specifically rather than using statistical analysis to identify common travelers, the system may simply seek individual wireless devices having location and vector information that substantially matches those for an already-identified route map.

In operation 245, the information provider 120 may transmit the route schedule data to a remote device (e.g., a personal computer, a display device 186 at a vehicle stopping station 185, or a wireless device 150 of a remote user 180). The route schedule data may be transmitted to the remote device as part of a regular, periodic transmission or as part of a response to a data request from a particular remote device. As previously described, the information provider 120 may include a report generator 122 or another subsystem that is capable of receiving data requests and obtaining route schedule data from the schedule generator 134. In response to the data requests, the report generator 122 may transmit one or more packets of information that includes the route schedule data so that schedule listings or stop location maps may be displayed on a remote device.

As previously described, in some embodiments, the route schedule data and other such information may be stored in an index internal to the information provider 120. The index may be updatable and search able, and in some circumstances, two or more parallel indexes that are optimized for various uses can be employed by the information provider 120. The index may be used, for example, by various services (e.g., a location-based alert service or other services described in more detail below) that are configured to query the index for particular route schedule data and/or other information and configured to transmit such data to a remote device (e.g., a wireless phone having an SMS application). In such circumstances, the service may be a report generator 122 in that it transmits the schedule data to a remote device.

As previously described, the information provider 120 may be configured to receive text messages from a SMS application of a remote wireless device and to transmit the data in the form of a text message for viewability using the SMS application of the remote device. In some embodiments, the information provider 120 may transmit the requested data in HTML format, XML format, or another format that can be displayed in a browser application of the remote device.

Furthermore, the information provider 120 may be configured to provide various types of information related to a mass transit vehicle in addition to route map data and schedule data. In one example, the report generator 122 or other subsystem of the information provider 120 may be configured to provide, in addition to route map data and schedule data, information associated with the future scheduled stops of the vehicle on that particular day (e.g., indicating whether the vehicle is early or late for subsequent stops). Further, the report generator 122 or other subsystem of the information provider 120 may be configured to provide the estimated duration of the vehicle at a particular stop location (e.g., the train will be boarding passengers from 3:12 PM to 3:16 PM). Such information may be helpful to a person who is accessing the vehicle information via his or her cellular phone while that person is trying to get to a particular stop location.

In another example, the report generator 122 or other subsystem of the information provider 120 may be configured to provide data associated with a particular vehicle's estimated time of arrival at a defined location. As previously described, the information provider 120 may identify the particular route that was queried by the remote device and compare the remote device's location information to the nearest stop location for that identified route. Then, the information provider 120 may compare the most recent location and speed information for that particular vehicle (using information from the group of wireless devices that are currently aboard the identified vehicle route) to the historical or previously aggregated schedule data for the identified route to determine the estimated time of arrival. Such information may be helpful to a person who is planning to go to a particular stop location and desires to know how much time is available before the mass transit vehicle arrives.

In a further example, the report generator 122 or other subsystem of the information provider 120 may be configured to provide an estimated time of passage at various points in the route map (e.g., crossing over the North River Bridge at 5:13 PM). This information may be determined by comparing the most recent location and speed information for that particular vehicle (using information from the group of wireless devices that are currently aboard the identified vehicle route) to the historical or previously aggregated route map data for the identified route.

In some embodiments, the information associated with the estimated time of arrival or the estimate time of passage at various points in the route may be intentionally skewed for security purposes. For example, the report generator 122 or other subsystem of the information provider 120 may be configured to add or subtract one minute or less from the estimated times so that the reported estimates are slightly skewed from the true estimates. As such, the information provider 120 can provide potential passengers with sufficiently accurate data associated with the estimated times of arrival (or other estimated times) without providing exact timing information. Similarly, the information provider 120 may be configured to intentionally skew the current location of the mass transit vehicle for security purposes. For example, the report generator 122 or other subsystem of the information provider 120 may be configured to add or subtract several meters or miles from the vehicle's current location so that the reported locations are slightly skewed from the true locations. In those circumstances, the information provider 120 can provide potential passengers with sufficiently accurate data associated with the vehicle's location without providing exact timing information.

Figure 4:
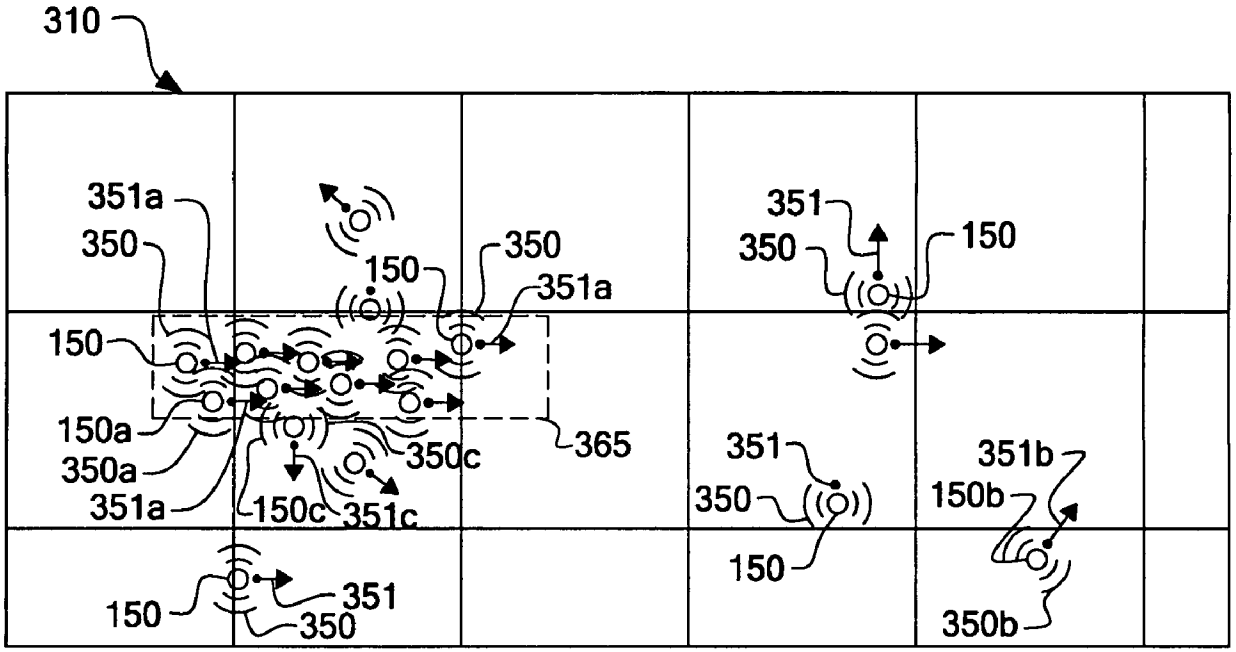
FIG. 4 is a diagram illustrating an exemplary geographic area in which the location information of a plurality of wireless devices may be determined.
Figure 5:
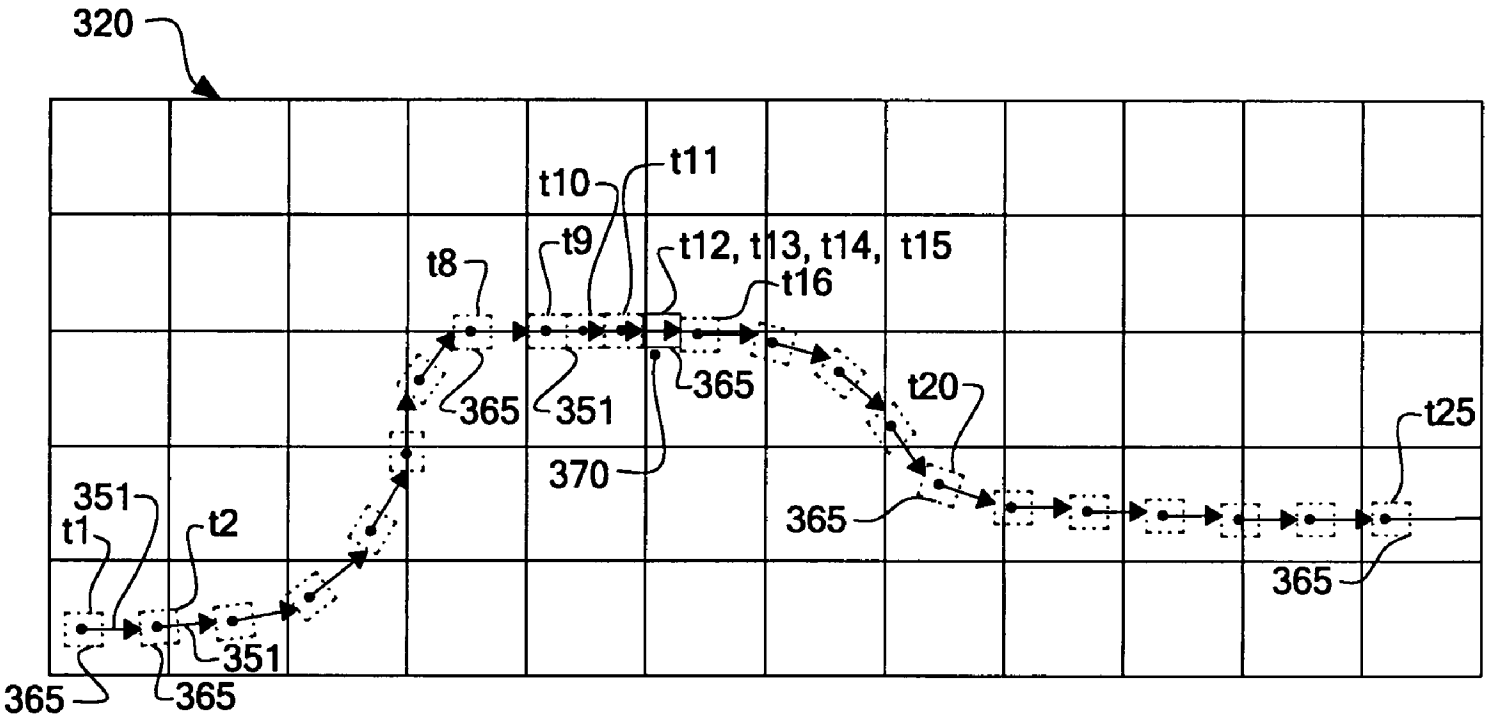
FIG. 5 is a diagram illustrating an exemplary route of a mass transit vehicle based upon the location information of passenger-carried devices of FIG. 3.
Figure 6:
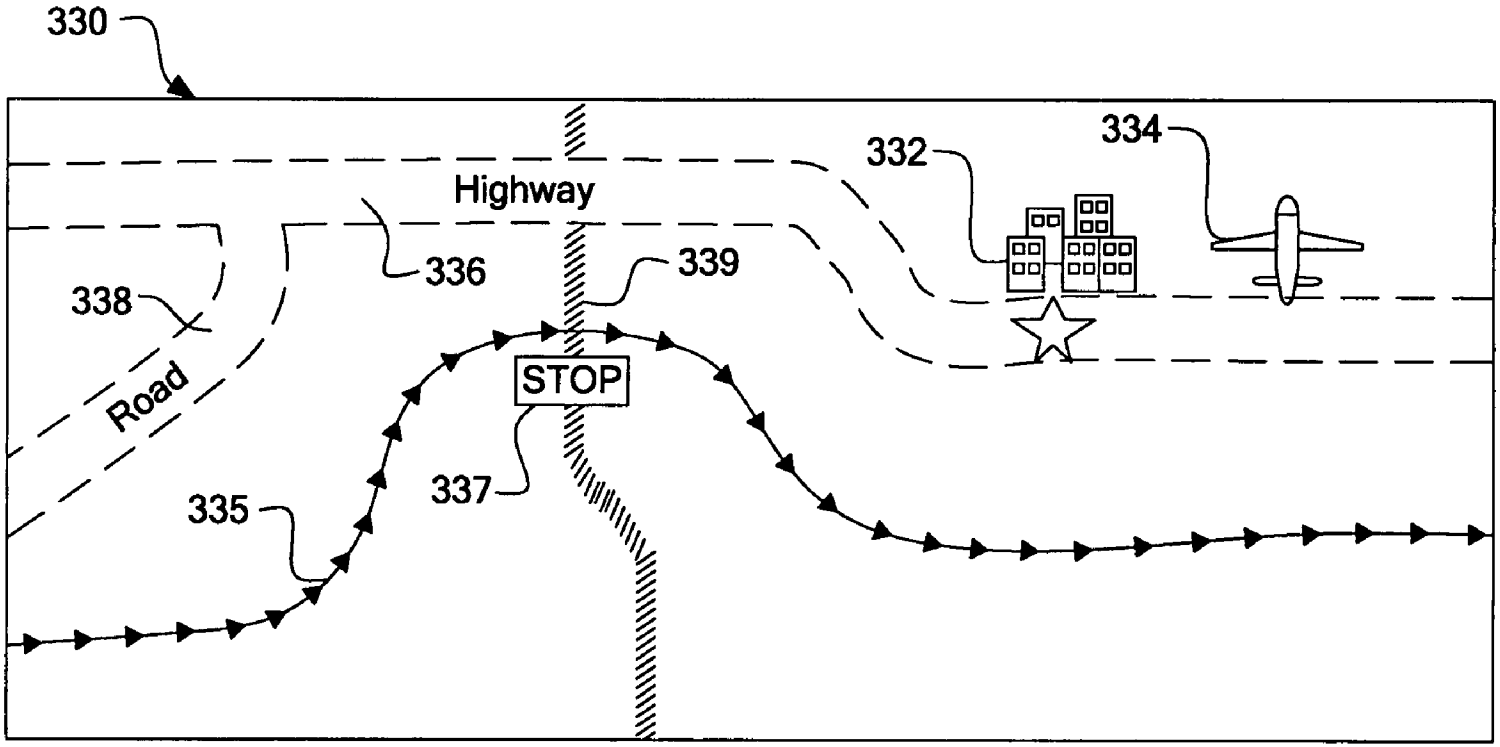
FIG. 6 is a diagram illustrating an exemplary route map representative of a plurality of locations of the mass transit vehicle over a period of time.

FIGS. 4-6 show diagrams of one example of the route map generation techniques. As shown in FIG. 4, in a given geographical area 310, there are a plurality of wireless devices 150 that are individually carried by different persons. It should be understood that FIG. 4 represents a diagram that visually illustrates some of the processes of the systems and methods described herein. The diagram itself is not necessarily displayed onscreen of any previously described device (in some embodiments, it may be displayed on a central or remote device), but rather represents some of the data that may be received or determined by the information provider 120. As previously described, the location information 350 for each of the wireless devices 150 may be received by the information provider 120. As such, the location 350*a* of one wireless device 150*a* may be determine to be substantially different from the location 350*b* another wireless device 150*b*. Also, the movement vectors 351 of the wireless devices 150 may be determined such that the movement vector 351 a of one wireless device 150*a* is substantially different from the movement vector 351 c of another wireless device 15*c*.

Still referring to FIG. 4, the information provider 120 may be adapted to filter information associated with some wireless devices 150 that do not meet certain criteria. For example, a wireless device 150*b* in the geographic area 310 may have a location 350*b* that is somewhat distant from other wireless devices 150. As such, the information provider 120 may filter out the information from the wireless device 150*b* for purposes of identifying a group of wireless devices 150 that are carried by passengers 160 riding aboard a mass transit vehicle 165. In another example, a wireless device 150*c* may have a substantially similar location 350*c* to a group of wireless devices (e.g., wireless device 150*a* and other near by devices), but the wireless device 150*c* has a substantially different movement vector 351*c* from the movement vectors (e.g., movement vector 351*a*) of the group of wireless devices. As such, the information provider 120 may filter out the information from the wireless device 150*c* for purposes of identifying a group of wireless devices 150 that are carried by passengers 160 riding aboard a mass transit vehicle 165.

Using statistical techniques based upon the location and time information gathered by the information provider 120, a group 365 of wireless devices 150 having substantially similar locations (e.g., in proximity to location 350*a*) and movement vectors (e.g., movement vector 351*a*). Based upon the number of wireless devices and the velocity profile of the wireless devices 150 in the group 365, this group 365 may be identified as those passenger-carried (or cargo-carried) wireless devices that are collectively riding aboard a mass transit vehicle 165. The statistical techniques may be known to those having skill in the art in statistics, machine learning, regression, optimization, optimal control, and other algorithmic/numerical techniques.

Referring now to FIG. 5, after the group 365 of wireless devices 150 has been identified, the location and time information for those wireless devices in that group 365 may be aggregated over a period time. For example, at time ($t_1$) the group 365 of wireless devices may have a particular location (as shown, for example, on the left side of the geographic area 320) and a particular movement vector 351. At time ($t_2$) the group 365 may have a different location (as shown, for example, to the right of the previous location). The aggregation of the location and time information may continue for a period of time (e.g., including $t_1$ through $t_{25}$ and beyond) so as to generate a listing of locations for route map data and to generate a listing of stop locations (e.g., location 370) for route schedule data. Aggregation may also occur even before a particular group has been identified as common travelers.

The stop locations for the group 365 of wireless devices may be determined from the movement vectors 351. In one example, from time ($t_8$) to time ($t_{11}$) the group 365 of wireless devices may have movement vectors 351 that indicate the group 365 is slowing down. From time ($t_{12}$) to time ($t_{15}$), the group 365 may have movement vectors 351 that indicate the group 365 is completely stopped over a period of time. The location information for the group 365 of wireless devices during this period of time (e.g., from time $t_{12}$ to time $t_{15}$) may be stored as a stop location 370 that can be part of the schedule data reported by the information provider 120. At time ($t_{16}$), the group 365 of wireless devices may have a movement vector 351 that indicates a forward motion after the vehicle stop is completed. Where only a subgroup of group 365 has registered its location during a time period, only the location and time information from that subgroup may be considered.

The aggregation of the location and time information for a group of wireless devices 150 inside a particular mass transit vehicle may continue over a period of days or weeks. Such information from different days or weeks may be used to refine the route map data and route schedule data (e.g., indicate that some stop locations do not occur everyday) reported by the information provider 120. Furthermore, it should be understood that location and time information from many groups of wireless devices 150 may be aggregated so as to generate route map data and route schedule data for a plurality of mass transit vehicle routes, any one of which may be reported by the information provider 120 to a remote device. Also, the location and time information for a particular group of wireless devices aboard a previously identified vehicle route may be aggregated again at a later time to update or incrementally change the route map data and/or route schedule data for that particular route.

Referring now to FIG. 6, after the route map data and route schedule data has been generated by the information provider 120, such data may overlay a map image 330, such as a satellite image or topographic map drawing. The map image 330 may correspond to the geographic area 320 that was analyzed as shown in FIG. 5. In some embodiments, at least a portion of the map image 330 may be provided by the report generator 122 of the information provider 120. The map image 330 may include previously known geographic features, such as cities 332, airports 334, highways 336, other roads 338, or the like. The route map data may be used to indicate the location of a mass transit vehicle's pathway 335 relative to the other geographic features. Also, in this embodiment, the route schedule data may be used to indicate a stop point 337 that corresponds to the vehicle stop location 370 (FIG. 5) previously determined by the information provider. As such, the route of a mass transit vehicle may be determined without the use of predetermined maps. Rather, the maps showing other geographic features may be incorporated after the location information for the vehicle's route has already been determined by the information provider 120. Furthermore, the information provider may include an function that determines what type of vehicle (e.g., on-road, off-road, train, plane, etc.) was identified based upon information such as the cluster size of the group of wireless devices, the velocity, the stop locations, the terrain over which the route passes, or the like.

This process of determining the vehicle's route without relying upon old or outdated maps may provide a more accurate estimate of the vehicle's route pathway and route schedule. For example, as shown in FIG. 6, the vehicle may consistently stop at an unofficial stop point 337 to pick up passengers. This unofficial stop point 337 may not be located on a road, on a highway, or in a large city that could be identified on an old map. Rather, the unofficial stop point 337 may be located proximal to a hidden or otherwise unmapped walking or biking pathway 339 that local villagers regularly use to intercept a train or a bus (e.g., a situation that occasionally occurs in India and other nations). For example, such a stop point 337 may be detected by identifying a location where a statistically significant number of previously ungrouped wireless devices engage the previous group of wireless devices that were known to be aboard the vehicle. Because the vehicle's route data and schedule data can be generated without reliance on old maps, the vehicle's route pathway 335 and stop points (e.g., stop point 337) may be accurately reported regardless of whether the vehicle uses unmapped pathways or unofficial stop points.

Furthermore, the location and time information corresponding to a particular mass transit vehicle may be obtained from a plurality of passenger-carried wireless devices 150 that are not registered with that particular vehicle. Accordingly, a robust system to gather and report route map information, vehicle schedule information, estimated time or arrival, and other vehicle information may be developed without the requirement of location monitoring devices that are physically mounted and registered to each and every mass transit vehicle in the fleet.

The route map data and schedule data generated by the information provider 120 may be used to provide a number of different services to remote users. For example, remote wireless devices 150 (e.g., a cellular phone or a PDA device) may be used to plan trips aboard one or more trains, buses, airplanes, or other mass transit vehicles. In such circumstances, the information provider 120 may supply more accurate information than static, pre-recorded schedules that are published by transit authorities. Moreover, the information provider 120 may provide access to route data and schedule data that would not otherwise be available to potential passengers (e.g., public train authorities in some countries do not publish train schedules).

In another example, the information provider 120 may be used to provide situational awareness features to passengers of the mass transit vehicle. In some cases, a passenger of a vehicle may desire to know the next possible stopping location or the future route locations. The wireless device carried by that passenger may be used to request such information without having to enter the user's location or time information. Instead, the user's location and time information can be automatically embedded in the data request using the previously described GPS or triangulation techniques. Based upon the user's location and time information, the report generator 122 may respond to the data request with information related to the vehicles next stopping location and the estimated duration of that stop (e.g., the response may include a text message stating "the train will stop at the River Dam with an 80% confidence in 32 minutes" even though the River Dam is not an officially scheduled stop on the literature published by the transit authority).

In a further example, the information provider 120 may be used to provide location-based services for those passengers aboard a particular mass transit vehicle. These services may be accessed, for example, using a passenger's cellular phone or a PDA device connected to a wireless network, a passenger's laptop computer that is connected to a Wifi network or other local network provided on the vehicle, or a public computer station accessible to a plurality of passengers aboard the vehicle. The location-based services may include location-based news, location-based factoids or zeitgeist alerts (e.g., used by tourists aboard a cross-country bus or train route), location-based advertisements, or localized web searches. For example, a passenger aboard a mass transit vehicle may send a data request via his or her cellular phone to the information provider 120 requesting information on the coffee shops close to the next stop location. The information provider 120 may use the passenger's location and time information that was embedded in the data request to identify a vehicle route and the next stop location. From there, the information provider 120 may include a subsystem to perform a localized web search of the coffee shops nearest to the identified stop location. The result of the localized web search may be reported back to the passenger's cellular phone.

In some embodiments, the location-based services may include automatic location-based notifications. For example, a wireless device user may subscribe to a service that automatically notifies the user of location-based events, such as train delays or current local news stories. In such circumstances, the information provider 120 may determine the user's location as previously described and then transmit a relevant mass transit alert or other locally relevant information.

In other embodiments, location-based advertisements (such as advertisements related to coffee shops near the next stop location) can be automatically transmitted to wireless devices or computer stations aboard the vehicle when the information provider 120 transmits responses to other data requests. For example, if a passenger aboard a vehicle sends a data request to the information provider 120 requesting the estimated time of arrival at the next stop location, the report generator 122 may transmit a response that reports the estimated time until the next stop location (as previously described). In addition, the response may include location-based advertisements that are associated with the vehicle's next stop location. The information provider 120 may use the passenger's location and time information that was embedded in the data request to identify a vehicle route and the next stop location. From there, the information provider 120 may include an advertisement generator or other subsystem to embed one or more advertisements in the response to the data request. As such, the passenger may receive the requested information (e.g., the estimated time of arrival at the next stop location) along with one or more advertisements pertinent to the location of the next stop. It should also be recognized that training of a system to determine the parameters of a route, may be distinct from obtaining latter data from devices that follow that route. For example, greater amounts of aggregated data may be required before a system has the confidence level necessary to conclude that a route is present at a particular path in the initial case. Once the route has been established, however, less data may be used to confirm that a mass transit vehicle is at a particular location along that route. For example, data may be aggregated over days or more to establish the repetition needed to conclude that a particular path is a transit route. In contrast, once the route has been determined, it may be enough to locate a single device moving along that route to determine where a mass transit vehicle is along the route—particularly if the received data is consistent with other data showing when a vehicle should be on the route. As such, the lesser amount of data may allow a system to report the progress of the vehicle, such as to a user waiting on a station platform and having a GPS-enabled device that reports the user's location, which location is checked against the location of various stops.

Various implementations of the systems and techniques described herein can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine-readable instructions for a programmable processor, and can be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT or LCD monitor or a audio output instrument such as a headset) for communicating information to the user and a user-input device (e.g., a keyboard or a pointing device, such as a mouse or a trackball) by which the user can provide input to the computer. Other kinds of devices can be used to provide for interaction with a user as well. For example, feedback provided to the user can be any form of sensory feedback (e.g., visual feedback, auditory feedback, or tactile feedback). In another example, input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

Although a few embodiments have been described in detail above, other modifications are possible. Some systems and methods described herein may be implemented in many different wireless networks, including by way of example, cellular voice networks; wide area wireless networks such as TDMA, CDMA, W-CDMA, GSM, satellite-based, or EDGE networks; metro area networks such as WiMAX networks; local area networks such as WiFi networks; and any other wireless networks that can deliver voice, data, information, gaming applications, business or utility applications, or other services over a large or small geographical area. Also, the logic flows depicted in the figures do not require the particular order shown, or sequential order, to achieve desirable results. Other steps may be provided, or steps may be eliminated, from the described flows, and other components may be added to, or removed from, the described systems.

A number of embodiments of the invention have been described. Nevertheless, it will be understood that various modifications may be made without departing from the spirit and scope of the invention. Accordingly, other embodiments are within the scope of the following claims.

What is claimed is:

1. A method of providing transportation-related information, comprising:

receiving location information indicative of a group of passenger-carried wireless telephone devices on board a mass transit vehicle selected from a group consisting of a bus, a train, and an airplane;

generating mass transit vehicle schedule information based at least in part on the location information indicative of the passenger-carried wireless telephone devices on board the mass transit vehicle; and transmitting data relating to the mass transit vehicle schedule information to a remote device in response to a user request.

2. The method of claim 1, wherein the group of passenger-carried wireless telephone devices comprise cellular telephones carried onto the mass transit vehicle by passengers or cargo of the mass transit vehicle.

3. The method of claim 1, further comprising aggregating at least some of the location information received over time from the passenger-carried wireless telephone devices, wherein the passenger-carried wireless telephone devices are not registered to the mass transit vehicle.

4. The method of claim 1, wherein the data relating to the schedule information comprises an estimated time of arrival by the mass transit vehicle at a predetermined location.

5. The method of claim 4, further comprising determining the estimated time of arrival using historical schedule information for the mass transit vehicle and calculated speed information based upon the location information associated with the plurality of wireless devices.

6. The method of claim 1, wherein the remote device comprises a remote wireless device and the data relating to the schedule information is transmitted in response to a request from the remote wireless device.

7. The method of claim 6, wherein the data relating to the schedule information is transmitted as a text message to the remote wireless device.

8. The method of claim 7, wherein the data relating to the schedule information depends on a location of the remote wireless device, and the location of the remote wireless device is automatically sent by the remote wireless device with the request.

9. The method of claim 1, wherein the remote device comprises an informational display at a mass transit terminal.

10. The method of claim 1, wherein the remote device comprises a wireless telephone carried by a passenger or prospective passenger of the mass transit vehicle and the data relating to the schedule information is transmitted in response to a request from the wireless telephone.

11. The method of claim 10, further comprising transmitting a location-based advertisement along with the data relating to the schedule information.

12. The method of claim 1, further comprising receiving, from at least one of the passenger-carried wireless telephones, information generated by a short-range wireless device located near the wireless telephone.

13. The method of claim 12, wherein the short-range wireless device is selected from the group comprising an RFID device, a Bluetooth device, and an IEEE 802.11-compliant device.

14. A method of tracking the travel of a mass transit vehicle, comprising:

receiving location information associated with a plurality of wireless devices carried by passengers or cargo of a mass transit vehicle;

aggregating the location information over a period of time so that the location information represents a plurality of locations of the mass transit vehicle; and generating vehicle path data that substantially includes the plurality of locations.

15. The method of claim 14, wherein the plurality of wireless devices comprise wireless telephones carried by passengers or cargo of the mass transit vehicle.

16. The method of claim 15, wherein the location information associated with the plurality of wireless telephones is automatically transmitted by the wireless telephones.

17. The method of claim 14, wherein the plurality of locations comprises a stop location for the mass transmit vehicle.

18. The method of claim 14, wherein the vehicle path data comprises route map data for the vehicle.

19. The method of claim 14, further comprising transmitting at least a portion of the vehicle path data to a remote device.

20. The method of claim 19, wherein the remote device comprises a wireless device and the at least a portion of the vehicle path data is transmitted in response to a request from the wireless device.

21. The method of claim 20, wherein the at least a portion of the vehicle path data is transmitted as a text message to the wireless device.

22. The method of claim 20, wherein the remote device comprises a wireless device carried by a passenger of the mass transit vehicle.

23. The method of claim 22, further comprising transmitting a location-based advertisement along with the vehicle path data, the location-based advertisement being associated with a stop location of the mass transit vehicle.

24. A system for providing transportation-related information, comprising:

an interface to receive location information indicative of a plurality of wireless devices carried by passengers or cargo on board a mass transit vehicle selected from a group consisting of a bus, a train, and an airplane; and means for generating schedule information associated with the mass transit vehicle based at least in part on the location information indicative of the plurality of wireless devices carried by passengers or cargo on board the mass transit vehicle, wherein, in response to a request from a remote device, the interface transmits data relating to the schedule information to the remote device.

25. The system of claim 24, wherein the means for generating schedule information includes a means for aggregating location information received over time and associated with a plurality of wireless devices not registered to the mass transit vehicle.

26. The system of claim 25, wherein the plurality of wireless devices comprise wireless telephones carried by passengers or cargo of the mass transit vehicle.

27. A system for providing transportation-related information, comprising:

an interface to receive location information indicative of a plurality of wireless devices carried by passengers or cargo on board a mass transit vehicle selected from a group consisting of a bus, a train, and an airplane;

a schedule generator in communication with the interface to determine schedule information related to a future location of the mass transit vehicle; and a report generator to receive information from the schedule generator and to provide schedule information to a remote device.

28. The system of claim 27, wherein the schedule generator includes a database that aggregates location information received over time and associated with a plurality of wireless devices not registered to the mass transit vehicle.

29. The system of claim 28, wherein the plurality of wireless devices comprise wireless telephones carried by passengers or cargo of the mass transit vehicle.

30. The system of claim 27, wherein the report generator transmits a text message to the remote device.

31. The system of claim 27, wherein the schedule information comprises an estimated time of arrival by the mass transit vehicle at a predetermined location.

32. The system of claim 27, wherein the remote device comprises an informational display at a mass transit terminal.

33. The system of claim 27, wherein the remote device comprises a wireless telephone carried by a current or future passenger of the mass transit vehicle and the schedule information is transmitted in response to a request from the wireless telephone.

34. The system of claim 33, wherein the report generator transmits a location-based advertisement along with the schedule information.

* * * * *

UNITED STATES PATENT AND TRADEMARK OFFICE

CERTIFICATE OF CORRECTION

PATENT NO. : 7,469,827 B2
APPLICATION NO. : 11/281843
DATED : December 30, 2008
INVENTOR(S) : Katragadda et al.

It is certified that error appears in the above-identified patent and that said Letters Patent is hereby corrected as shown below:

On the title page,

[*] Notice: Subject to any disclaimer, the term of this patent is extended or adjusted under 35 USC 154(b) by 426 days Delete the phrase "by 426 days" and insert -- by 469 days --

Signed and Sealed this

Fourth Day of May, 2010

David J. Kappos

David J. Kappos
*Director of the United States Patent and Trademark Office*